United States Patent [19]

Morehead

[11] 4,020,378

[45] Apr. 26, 1977

[54] INTEGRAL MERCURY-VAPOR PRESSURE REGULATING MEANS FOR FLUORESCENT LAMP

[75] Inventor: Chalmers Morehead, Upper Montclair, N.J.

[73] Assignee: Westinghouse Electric Corporation, Pittsburgh, Pa.

[22] Filed: Jan. 26, 1976

[21] Appl. No.: 652,360

Related U.S. Application Data

[63] Continuation of Ser. No. 293,239, Sept. 28, 1972, abandoned.

[52] U.S. Cl. ..... 313/174; 313/178; 313/225; 313/228; 315/108

[51] Int. Cl.[2] ..... H01J 61/20; H01J 61/28; H01J 61/35; H01J 61/72

[58] Field of Search ..... 313/174, 176, 177, 178, 313/225, 227, 228, 229; 315/108

[56] References Cited

UNITED STATES PATENTS

| | | | |
|---|---|---|---|
| 2,262,177 | 11/1941 | Germer | 313/174 X |
| 2,280,618 | 4/1942 | Besson | 313/174 X |
| 3,336,502 | 8/1967 | Gilliatt | 315/108 |

*Primary Examiner*—Alfred E. Smith
*Assistant Examiner*—Marvin Nussbaum
*Attorney, Agent, or Firm*—D. S. Buleza

[57] ABSTRACT

The mercury-vapor pressure within a fluorescent lamp is controlled by a metal (indium or an alloy of indium and tin, for example) that wets glass, combines with the mercury within the lamp to form an amalgam and is divided into segments which are fused directly to one or both of the glass stems at spaced locations. The amalgamative-metal segments are of such shape and mass that they inherently remain in place on the stem when they are heat-softened and pressed onto the glass surface. Segments of larger size and mass are retained in place by an overlying porous layer of inert material that adheres to the glass or by an embedded wire mesh member and an exterior porous coating of inert material. The amalgamative metal can also be combined with a fusible binder to form a composite which is divided into small pellets that are pressed onto the glass stem and held in place by the adhesive action of the binder when the latter is fused during the bulb-lehring operation required to fabricate the lamp.

22 Claims, 11 Drawing Figures

INTEGRAL MERCURY-VAPOR PRESSURE REGULATING MEANS FOR FLUORESCENT LAMP

This is a continuation of application Ser. No. 293,239 filed Sept. 28, 1972, abandoned.

BACKGROUND OF THE INVENTION

1. Field of the Invention

This invention relates to low-pressure electric discharge lamps and has particular reference to an improved fluorescent lamp in which the mercury-vapor pressure is regulated by means of an amalgam.

2. Description of the Prior Art

Low-pressure mercury-vapor discharge lamps that contain a strategically located metal (such as indium, cadmium, etc.) which forms an amalgam with mercury and regulates the mercury-vapor pressure within the lamp during operation are well known in the art. A fluorescent lamp of this type having an amalgam-forming metal located on the inner surface of the phosphor-coated envelope is described in U.S. Pat. No. 3,007,071 issued Oct. 31, 1961 to A. Lompe et al.

It is also known in the art that the time required for a fluorescent lamp to reach full light output from a "cold start" can be reduced by placing an auxiliary quantity of amalgam at a location within the lamp where it will be quickly heated and thus rapidly supply mercury-vapor to the discharge. A lamp having such an auxiliary amalgam disposed on one of the anodes near the cathode is disclosed in U.S. Pat. No. 3,227,907 issued Jan. 4, 1966 to C. J. Bernier et al.

A high-output fluorescent lamp having a continuous coating of amalgamative metal on the tubular portions of the glass stems is disclosed in U.S. Pat. No. 3,287,587 issued Nov. 22, 1966 to R. A. Menelly.

A fluorescent lamp containing an amalgamative metal that is divided into two flat strips which are held in place on the stem by a wire-mesh collar assembly is disclosed in U.S. Pat. No. 3,534,121 issued Oct. 13, 1970 to G. S. Evans. An improved lamp of this type in which the amalgamative-metal strips are retained in place on the stem within the wire-mesh collar assembly by an overlying strip of fine-wire mesh is disclosed in U.S. Pat. No. 3,422,299 issued Jan. 14, 1969 to C. Morehead, the author of the present invention.

While the aforesaid prior art innovations achieved the desired primary objective of controlling the mercury-vapor pressure within the lamp when the latter is operated under high ambient-temperature conditions or at high power loadings, they are not entirely satisfactory from a cost or manufacturing standpoint since they require relatively expensive components and time-consuming manual operations.

Applying the amalgamative metal to the stem in the form of a continuous coating poses another problem in that it limits the quantity of metal that can be placed at the proper location within the lamp. Larger stems or thick coatings must therefore be used in lamps of long length that require large quantities of amalgam. Thick coatings are impractical since they permit the fluid amalgam to drip from the stem and thus become dislocated.

There is, accordingly, a need for a lamp of the amalgam type that has a minimum number of parts and can be efficiently assembled on a mass-production basis. It would also be very desirable to have an amalgam vapor-regulation means that could be employed on the short stems customarily used for standard 40 watt T12 fluorescent lamps and which would also permit large quantities of amalgamative metal to be applied directly onto the stems at the proper location.

SUMMARY OF THE INVENTION

A simple inexpensive vapor-regulating means which meets these requirements is provided in accordance with the present invention by dividing the amalgam-forming metal into a number of small segments or "bits" and placing them at spaced locations directly on the glass stem a predetermined distance from the associated electrode. According to one embodiment, the bits of amalgam-forming metal are of such size and shape that they are held in place on the glass stem solely by the fact that the metal wets and thus inherently sticks to the glass surface. In other embodiments, the segments of amalgam-forming metal are of larger size and are held in place by a porous adherent coating of inert material, by an admixed porous binder, or by embedding a foraminous member in the amalgamative metal segments, and coating the outer surface of the resulting assembly with a porous layer of inert material.

The flared or tubular portions of the glass stems can also be provided with spaced indents or groove-like recesses that serve as retaining pockets for the amalgamative metal bits.

Since the present invention permits a large total quantity of amalgamative metal to be placed and retained directly on the glass stem without any separate holding means (or with the aid of a simple and inexpensive retaining component), it reduces the manufacturing cost of the lamp and permits amalgam-type vapor-pressure control means to be employed in standard 40 watt fluorescent lamps having short stems as well as in higher wattage lamps that have stems of longer length.

BRIEF DESCRIPTION OF THE DRAWINGS

A better understanding of the invention will be obtained from the exemplary embodiments that will be subsequently described and are illustrated in the accompanying drawings, in which.

DESCRIPTION OF THE PREFERRED EMBODIMENTS

Figure 1:
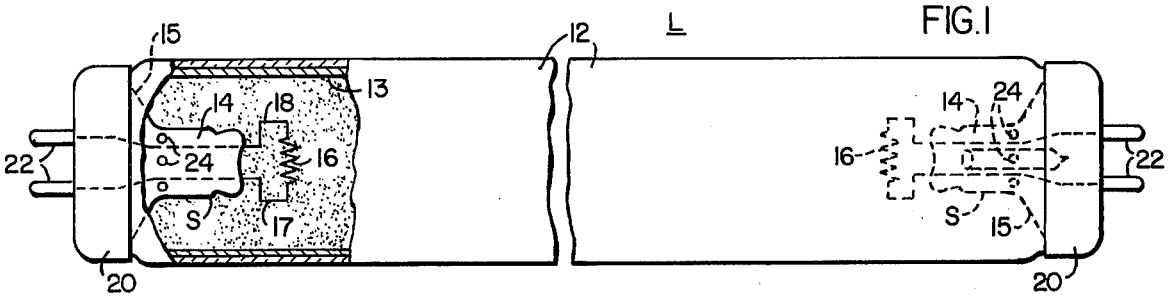
FIG. 1 is an elevational view of a 40 watt fluorescent lamp that embodies the invention, portions of the envelope being broken away for illustrative purposes.

With specific reference now to the drawings, in FIG. 1 there is shown a fluorescent lamp L having the usual tubular vitreous envelope 12 the inner surface of which is coated with a layer 13 of a suitable ultraviolet-responsive phosphor. The envelope 12 is closed at each end by a vitreous stem S that consists of a glass tube 14 having a flared end portion 15 that is fused to the rim of the envelope. A thermionic electrode 16 is supported at each end of the envelope 12 by lead wires 17 and 18 that are embedded in the fused press-sealed end of the stem tube 14 and extend through suitable base members 20 attached to the ends of the envelope and, thence, into hollow pin terminals 22 to which they are electrically connected, as by welding. After the lamp has been baked and evacuated it is charged with a suitable inert fill gas (argon or a mixture of argon and neon at about 3 mm. of Hg. pressure, for example), dosed with a measured amount of mercury and tipped-off in the well known manner.

In accordance with the present invention, the mercury-vapor pressure within the lamp L during operation is controlled by a plurality of discrete segments or bits 24 of a suitable amalgam-forming metal (such as indium or an indium-rich alloy of indium and tin) that are disposed at spaced locations around the circumference of the respective stems S a predetermined distance from the associated electrodes 16.

Figure 2:
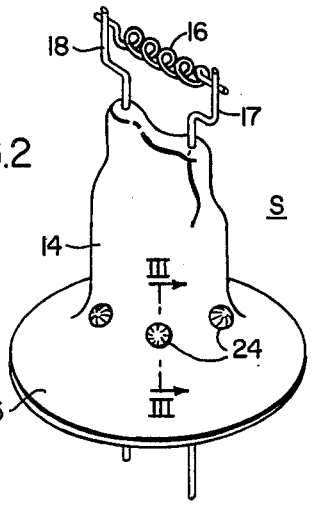
FIG. 2 is an enlarged perspective view of one of the short stems employed in the lamp shown in FIG. 1.
Figure 3:
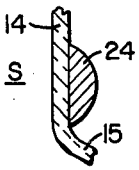
FIG. 3 is a cross-sectional view of the amalgam-carrying portion of the stem taken along the line III—III of FIG. 2.

As shown more particularly in FIGS. 2 and 3, the bits 24 of amalgamative metal are of generally hemispheroidal or flattened configuration and are located adjacent the shoulder formed by the juncture of tube portion 14 and the flared portion 14 of the stem S. This is the most desirable location for a 40 watt lamp which has a T12 envelope (38.1 mm. outside diameter), an overall length of about 122 centimeters, and "short" stems of the type shown (approximately 3.5 centimeters long) since the amalgam which is subsequently formed within the completed lamp L operates at the proper temperature to maintain the mercury-vapor pressure within the desired range of from about 3 to 14 microns when the lamp is operated at its rated wattage.

The bits 24 of amalgamative metal are fused to the stem S by heating the glass sufficiently to melt or soften the metal and then simply pressing the metal bits against the heated stem and holding them in place until the glass and metal cool. Since indium and indium-rich In-Sn alloys begin to melt at around 156° C. and "wet" glass, only a slight amount of heating is required to anchor the metal bits in place.

Athough the fused segments 24 of metal (and the amalgam which they subsequently form with the mercury inside the finished lamp L) wet and thus inherently cling to the stem surfaces, it has been found that if the segments or bits of amalgamative metal are too large they sometimes become detached, particularly when the metal is in a liquid or semi-liquid state during lamp exhaust and the lamps are handled in the factory while they are still hot. This potential problem is avoided according to the invention by controlling the shape and size or mass of the amalgamative metal segments.

Specifically, the configuration of the metal bits 24 is such that they have sufficient surface area in contact with the surface of the glass stems S to insure that they will each support their own weight during lamp manufacture and subsequent handling of the lamp when the metal (or amalgam) is in a fluid condition. Care should thus be exercised to prevent the tendency of the fused metal bits to become spherical during the attachment operation and thereby reducing the contact area to a value which is too small. In addition, each piece of metal is made small enough to have sufficient cohesiveness to remain attached as a unit to the stem during lamp processing and handling in the factory. The smaller the individual segments or bits of amalgamative metal, the more favorable the adhesion and cohesion conditions become.

As a specific example, it has been found that a hemispherical piece of indium 2 millimeters in diameter has a mass of about 15.5 milligrams and a flat surface of about 3.14 square millimeters, and that bits of indium nominally 10 milligrams in mass and with a glass wetting (flat) area of approximately 3 square millimeters have satisfactory stability during the lamp-making operations and remain on the stems. Thus, in order for a 10 milligram piece of indium to have at least a 3 square millimeter contacting area, it should be flatter than hemispherical in shape. All of these criteria can be met by cutting the pieces from a flat strip or ribbon of indium and fusing them to the glass surface of the stem. As a result of the slight rounding off of the flat "coin-like" pieces which occurs during the fusion process, the metal bits 24 will have a generally flat hemispheroidal shape such as that shown in FIG. 3.

In the case of a 40 watt fluorescent lamp having a length of about 122 centimeters and containing approximately 20 milligrams of mercury and about 90 milligrams of an amalgamative metal such as indium, the separation of the amalgamative metal into discrete bits each having a mass of approximately 9 milligrams requires that 10 such bits of metal be employed in a lamp of this type. Each of the stems S is thus provided with five circumferentially-spaced bits 24 of amalgamative metal, as shown in FIG. 1. The fact that the amalgamative material is divided into a plurality of segments affords an additional safeguard with regard to lamp operability in that if one or two of the segments should become dislodged during lamp processing or burning, the remaining segments will provide a sufficient amount of amalgam at the desired location to give proper mercury-vapor pressure control.

Figure 4:
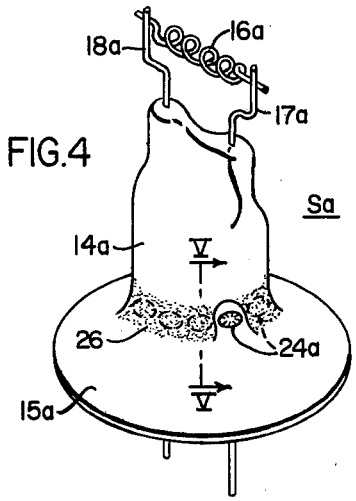
FIG. 4 is a pictorial view of an alternative embodiment wherein the segments of amalgamative metal are retained in place on the stem by an overloading porous layer of inert material.
Figure 5:
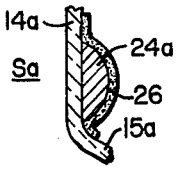
FIG. 5 is an enlarged cross-sectional view of the amalgam-carrying portion of the stem and the associated coating along the line V—V of FIG. 4.

If pieces of amalgamative metal having a mass larger than about 10 milligrams are employed, or if bits of metal having less than 3 square mm. of contacting area are used, then supplementary means for retaining them in place on the lamp stems are required. Adequate retention can be accomplished in such cases by using a porous layer of inert material. A fluorescent lamp stem $S_a$ embodying this form of the invention is shown in FIG. 4. As will be noted, the bits 24*a* of amalgamative metal are arranged in circumferentially-spaced position around the tubular part 14*a* of the stem $S_a$ adjacent the curved junction with the flared portion 15*a* as in the previous embodiment. The metal bits 24*a* are retained at this location by an overlying porous layer 26 of suitable material that is inert and encircles the stem in band-like fashion. A shown more particularly in FIG. 5, the porous layer 26 extends over and beyond each of the metal segments 24*a* and is bonded to the surrounding areas of the stem tube 14*a*. The amalgamative metal pieces 24*a* are thus securely held in place on the stem $S_a$ a predetermined distance from the electrode 16*a*.

As a specific example, the porous retaining layer 26 can comprise a thin film of a finely-divided material, such as titanium dioxide or zirconium dioxide, that will remain stable under the conditions of lamp manufacture and operation and thus will not contaminate the lamp. A sufficiently thin and porous film can be obtained by suspending powdered titania (or zirconia, or a blend of $TiO_2$ and $ZrO_2$) in a nitrocellulose lacquer and applying the resultant paint over the portion of the lamp stem $S_a$ to which the bits 24*a* of amalgamative metal have been fused. Upon drying, the lacquer holds the metal bits in place while the lamp is being baked prior to and during exhaust. The elevated temperature during the baking operation vaporizes the nitrocellulose and the latter is removed from the lamp, along with the volatilized material from the phosphor coating, during the exhaust operation. A thin porous film 26 of finely-divided inert material thus remains in overlying relationship with the amalgamative metal bits 24*a* and adjacent parts of the stem $S_a$ in the finished lamp L.

When segments of amalgam metal much larger than 10 milligrams are employed, "flaking-off" of the porous titania or zirconia coating 26 may occur as a result of the increase in the volume of the metal segments when they combine with the mercury and form the amalgam. This problem can be circumvented by including an inert binding material in the coating. As a specific example, good results have been obtained by admixing boric acid ($H_3BO_3$) with the powdered titania (or zirconia) and nitrocellulose vehicle. At the temperatures which occur during the sealing and exhaust operations in manufacturing the lamp, the boric acid loses $H_2O$ form boric anhydride ($B_2O_3$) which fuses into a vitreous state and thus binds the titania (or zirconia) powder into an inert coating in the finished lamp that is sufficiently firm and elastic to contain the formed amalgam and yet is porous enough to permit the passage of mercury vapor into and out of the amalgamative metal. A weight ratio of around 25% boric acid in the dry mixture with an infusible inert powder (such as titania or zirconia) that is subsequently suspended in a suitable volatile vehicle, such as nitrocellulose, has given satisfactory results.

Other fusible binding materials may be used instead of boric acid. For example, any of the fluorides or oxides that have relatively low melting points and low vapor pressures under lamp operating conditions can be used. Lead monoxide (PbO) is a specific example, even though its melting point (888° C) would probably require that the applied coating be separately heated prior to the lamp-sealing operation in order to properly fuse the PbO. Blends of such materials can also be used.

Figure 6:
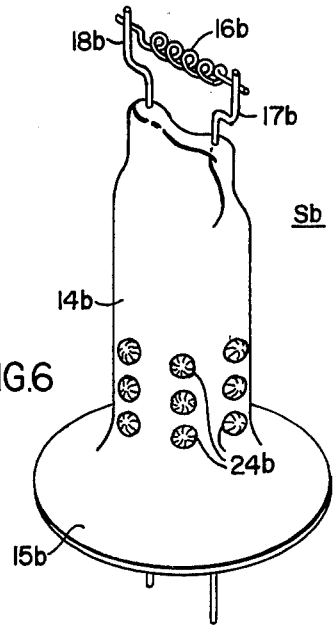
FIG. 6 is a perspective view of a long stem for an alternative lamp embodiment which is adapted for operation at high power loadings.

The present invention can also be used in fluorescent lamps designed for operation at power loadings greater than that employed in standard 40 watts lamps which operate at about 10 watts per foot of arc length. These high-powered lamps are designed to operate at currents of about 1500 milliamperes (approximately 29 watts per foot of arc length) and are manufactured in 183 cm. and 244 cm. lengths. A stem $S_b$ for a lamp of this type is shown in FIG. 6. As will be noted, the stem is longer than those previously described in order to permit the amalgamative metal to be positioned further away from the electrode 16*b* within the cooler end of the lamp. As in the case of the peviously-described embodiments, the amalgamative metal is divided into small segments or bits 24*b* that are fused directly to the tubular portion 14*b* of the stem $S_b$ remote from the stem press which is fused and hermetically sealed around the lead wires 17*b* and 18*b*. Since such highly-loaded flurorescent lamps require a larger dose of mercury, a correspondingy larger total amount of amalgamative metal is required per lamp. Thus, a larger number of metal bits 24*b* are needed per stem and they can be arranged in spaced rows that extend around the circumference of the stem tube 14*b* inwardly a short distance from the flare 15*b*, as illustrated.

As a specific example, in a 1500 ma. fluorescent lamp 183 cm. long which contains about 50 mg. of mercury approximately 225 mg. of amalgamative metal is employed for satisfactory operation. If metal bits of 9 mg. size are used, then a total of around 26 bits would be required (13 bits per stem).

The corresponding data for a 1500 ma. lamp having a length of 244 cm. are; 100 mg. of mercury, 450 mg. of amalgamative metal, 50 bits of metal (having a mass of 9 mg. each), and 25 bits of metal per stem.

Figure 7:
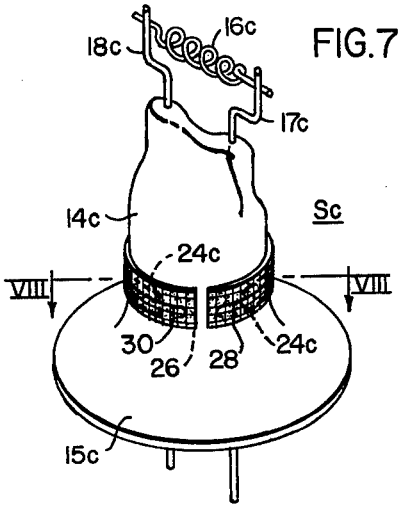
FIG. 7 is a pictorial view of a modified form of a short stem for a standard size 40 watt lamp according to the invention.
Figure 8:
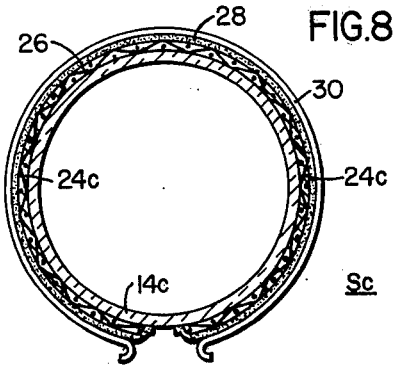
FIG. 8 is an enlarged cross-sectional view of the stem and vapor-control component along line VIII—VIII of FIG. 7.

In FIGS. 7 and 8 there is shown another "short stem" embodiment wherein the amalgamative metal is divided into two rectangular strips 24*c* that are pressed into a longer and wider strip of foraminous material, such as a rectangular piece of wire mesh 26. The resulting composite is bent into a circular collar, as shown, and the outer surface of the collar is covered with a porous coating 28 of inert finely-divided material (of the type described above) to prevent the metal (or subsequently-formed amalgam) from leaking out of the wire mesh when the metal (or amalgam) is in a fluid or semi-fluid state. The porous coating 28 of inert material in this embodiment thus serves the same function as and replaces the fine-mesh outer component of the amalgam-collar assembly described in the aforementioned U.S. Pat. No. 3,422,299 issued to the present inventor.

The coating 28 of inert material may be applied by painting, spraying or rolling the mesh-metal collar in a shallow bath of the paint formed by suspending the titania (or zirconia) powder in a suitable volatile vehicle. The collar is then slipped around the tubular portion 14*c* of the glass stem $S_c$ and locked in place by an encircling wire ring 30 so that the amalgamative metal strips 24*c* are located proximate the flared skirt 15*c* remote from the stem press and the electrode 16*c*. In the finished lamp, the amalgamative metal segments 24*c* and subsequently formed amalgam are fused to the surface of the stem $S_c$ and are retained in encircling end-to-end position thereon by the embedded portion of the wire mesh strip 26 and the overlying porous coating 28 of inert material.

Figure 9:
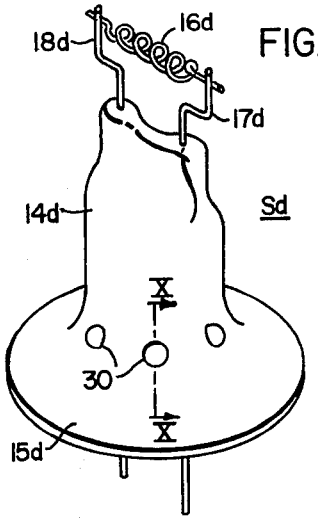
FIG. 9 is a perspective view of another short stem and amalgam structure for an alternative lamp embodiment.

In FIG. 9 there is shown an alternative embodiment comprising a glass stem $S_d$ in which the amalgamative metal is admixed with a suitable fusible binder material and a non-fusible material (such as a mixture of boric oxide with titania or zirconia) and formed into small pellets 30 of generally spherical shape that are less than about 1 millimeter or so in diameter and are attached to the tubular portion 14*d* of the stem at spaced locations adjacent the flared portion 15*d*. During the exhaust-bake phases of lamp manufacture, the water vapor is driven from the boric acid and forms boric anhydride which fuses with the titania (or zirconia) and provides a porous matrix that cements or bonds the metal-containing pellets 30 to the stem $S_d$. The pellets can accordingly be simply pressed onto the stem and will be automatically fused to the glass during the exhaust-baking operation. This eliminates the necessity of fusing each individual piece of amalgamative metal to the glass, as in the case when bits of unadulterated metal are used.

Figure 11:
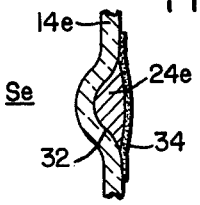
FIG. 11 is a similar view of another stem emodiment wherein the amalgamative metal is disposed in spaced indents or cavities formed in the outer surface of the stem.

According to a further embodiment (shown in FIG. 11), the bits or segments 24*e* of amalgamative metal are pressed into recesses or indents 32 of circular or groove-like shape that are provided in the stem tube 14*e* and thus serve as pockets for the metal. The filling of amalgamative metal is retained in place within these pockets by a suitable porous coating 34 of inert material that extends beyond the recesses 32 and adheres to the surrounding portions of the stem $S_e$.

Figure 10:
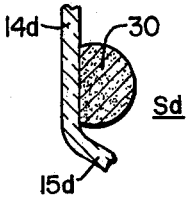
FIG. 10 is an enlarged cross-sectional view of the amalgam-carrying portion of the stem taken along the line X—X of FIG. 9.

As will be apparent to those skilled in the art, the recesses or pockets can be of various shapes and can also be provided on the flared portion of the stem, or on any vitreous or glass part of the lamp structure wherever an inexpensive and effective means for retaining a mercury-vapor controlling amalgam is desired. If a suitable fusible binding material is admixed with the amalgamative metal (as in the FIGS. 9 and 10 embodiment), then the porous coating 34 can be omitted. Such coating may also be omitted if the recesses in the stem are shaped to provide a constricted opening which prevents the amalgamative metal from falling or leaking out of the recesses.

I claim as my invention:

1. In a low-pressure electric discharge lamp having an envelope that contains an ionizable medium which includes mercury, integral means for controlling the mercury-vapor pressure within the lamp during operation comprising;

a vitreous stem secured to and extending inwardly into said envelope, an electrode supported beyond the inner end of said stem, and a predetermined quantity of a metal that combines with the mercury in the lamp and forms an amalgam which regulates the mercury-vapor pressure within the lamp during operation thereof, said predetermined quantity of amalgamative metal being divided into a plurality of discrete segments that are fused to the surface of a selected portion of said stem and are disposed at spaced locations around the periphery of said selected stem portion in such physical relationship with said electrode that the formed amalgam segments maintain the mercury-vapor pressure within a selected range when the lamp is energized and operated.

2. The discharge lamp of claim 1 wherein each of said amalgamative-metal segments is retained in position on the stem by a porous adherent layer of inert material that extends over said metal segments and the surrounding portions of said stem.

3. The discharge lamp of claim 1 wherein said amalgamative-metal segments contain admixed finely-divided material and a fused binder which together constitute an inert porous matrix that bonds the metal segments to the stem.

4. In a fluorescent lamp that is adapted for operation at a predetermined power loading and has an elongated glass envelope, the combination of;

a glass stem that has a tubular portion and a flared portion which is sealed to an end of said envelope, an electrode supported at a location beyond said stem by lead wires that are sealed through a fused part of said stem, and p1 means for controlling the mercury-vapor pressure within said envelope when the lamp is operated at said power loading comprising a plurality of discrete bits of mercury-containing amalgam that wet and are bonded to the surface of a selected part of said stem, said amalgam bits being disposed in spaced-apart array around the circumference of said selected part of the stem.

5. The fluorescent lamp of claim 4 wherein;

each of said bits of amalgam are of substantially the same size and have a mass no greater than about 10 milligrams, and the major constituent of said amalgam comprises indium.

6. The fuorescent lamp of claim 4 wherein;

said lamp has a nominal rating of 40 watts and is approximately 122 centimeters long, and said bits of amalgam are arrayed around the circumference of said stem adjacent the flared portion thereof.

7. The 40 watt fluorescent lamp of claim 6 wherein each of said bits of amalgam have a mass no greater than about 10 milligrams and a configuration such that they are each in contact with at least approximately 3 square millimeters of the stem surface.

8. The fluorescent lamp of claim 4 wherein;

said lamp is adapted to operate at a power loading in excess of about 10 watts per foot of arc length, and said bits of amalgam are located on the tubular portion of said stem inwardly from the flared portion thereof.

9. The fluorescent lamp of claim 8 wherein said bits of amalgam are disposed in rows that are spaced from one another and extend around the circumference of the tubular portion of said stem.

10. the fluorescent lamp of claim 4 wherein each of said bits of amalgam are of substantially the same size, have a mass greater than 10 milligrams and are retained in place on said stem by a porous adherent layer of inert material.

11. The fluorescent lamp of claim 10 wherein said layer of inert material comprises a mixture of (a) an unfused material selected from the group consisting of titania, zirconia, and blends thereof and (b) a fused binder selected from the group consisting of boric oxide lead monoxide, and blends thereof.

12. The fluorescent lamp of claim 11 wherein said porous layer of inert material consists essentially of admixed titania and fused boric anhydride.

13. The fluorescent lamp of claim 4 wherein said bits of amalgam are located in recesses in the surface of the stem.

14. The fluorescent lamp of claim 13 wherein a porous layer of inert material extends over each of said bits of amalgam and is bonded to the portions of said stem that surround the respective recesses.

15. The fluorescent lamp of claim 4 wherein said bits of amalgam are of rounded configuration and contain an inert admixed material that constitutes a porous matrix which is fused to the stem.

16. The fluorescent lamp of claim 15 wherein;

said bits of amagam are less than about 1 millimeter in diameter, and said inert admixed material comprises a mixture of powdered titania and fused boric anhydride.

17. The fluorescent lamp of claim 4 wherein;

said bits of amalgam comprise elongated strips that are disposed in end-to-end spaced apart relation around the circumference of the tubular portion of said stem, a single strip of foraminous material is embedded in and extends beyond the sides and ends of the amalgam strips, and the exposed surfaces of said strips of amalgam and foraminous material are coated with a porous layer of inert powdered material.

18. The fluorescent of claim 17 wherein said strip of foraminous material comprises a piece of wire mesh and said porous layer of inert material extends over the entire outer surface of said wire mesh and the amalgam strips.

19. In a low-pressure gaseous discharge lamp having a sealed light-transmitting envelope that contains mercury, the combination comprising;

a member that constitutes an interior structural part of the lamp and has a surface portion that is indented and defines a recess which is accessible to mercury vapor produced within the envelope when the lamp is energized, an electrode supported within said envelope at a location remote from said member, a metal disposed within the recess in said member, said metal being of a type that combines with mercury and forms an amalgam, and means retaining said metal in the recess defined by said member.

20. The combination of claim 19 wherein said retaining means comprises a porous layer of inert material that extends over the recess and is attached to the surrounding portion of the member.

21. The combination of claim 19 wherein said retaining means comprises a binder that is admixed with the amalgamative metal and is fused to the surface of said member.

22. The combination of claim 19 wherein the indented portion of said member is of such configuration that the recess has a constricted opening which retains the amalgamative metal in said recess.

* * * * *